US006712604B2

(12) United States Patent
Havlena

(10) Patent No.: US 6,712,604 B2
(45) Date of Patent: Mar. 30, 2004

(54) CAUTIOUS OPTIMIZATION STRATEGY FOR EMISSION REDUCTION

(75) Inventor: Vladimir Havlena, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 8 days.

(21) Appl. No.: 09/882,870

(22) Filed: Jun. 15, 2001

(65) Prior Publication Data

US 2002/0192609 A1 Dec. 19, 2002

(51) Int. Cl.[7] ..... F23N 5/24
(52) U.S. Cl. ..... 431/12
(58) Field of Search ..... 431/5; 73/1; 60/274; 423/213.5; 123/119

(56) References Cited

U.S. PATENT DOCUMENTS 3,886,260 A * 5/1975 Unland ..... 423/213.5
4,163,433 A * 8/1979 Fujishiro ..... 123/119
4,202,301 A * 5/1980 Early et al. ..... 123/119
4,526,001 A * 7/1985 Burns et al. ..... 60/274
4,852,384 A * 8/1989 Woolbert et al. ..... 73/1
5,511,971 A 4/1996 Benz et al.
5,759,022 A * 6/1998 Koppang et al. ..... 431/5
6,012,282 A * 1/2000 Kato et al. ..... 60/274
6,039,261 A 3/2000 Pavese
6,190,190 B1 2/2001 Hibon et al.

* cited by examiner

*Primary Examiner*—Henry Bennett
(74) *Attorney, Agent, or Firm*—Kris T. Fredrick

(57) ABSTRACT

A system of controlling combustion of fuel in a boiler having an adjustable air-to-fuel ratio. A first sensor is used to measure the CO production to provide a CO distribution range during a period of time for the combustion A second sensor measures the $NO_x$ production to provide a $NO_x$ distribution range during this period of time for the combustion. A controller adjusts the air-to-fuel ratio to cause combustion of the fuel within the CO distribution range and the $NO_x$ distribution range to thereby cause the actual emission for the CO and $NO_x$ distributions to average less than the maximum permitted. Preferred time ranges are from 15 to 30 minutes, and the air-to-fuel ratio is selected to produce actual emissions averaging 95% of said maximum.

12 Claims, 1 Drawing Sheet

CAUTIOUS OPTIMIZATION STRATEGY FOR EMISSION REDUCTION

FIELD OF THE INVENTION

The present invention relates to control of various variables in emissions in combustion. More particularly the invention relates to use of carbon monoxide emissions in pulverized coal fired boilers to achieve low $NO_x$ production and high efficiency burning.

BACKGROUND OF THE INVENTION

The use of pulverized coal fired boilers has long been a source of energy. As concerns for fuel burning efficiency and emissions has become more important, as part of an increasing world-wide concern for conserving energy and protecting the environment, various methods have been proposed for reducing undesirable emissions from combustion plants.

Reduction of the production of $NO_x$ is particularly desirable since this emission product is recognized as one of the chief sources of acid rain, in addition to $SO_2$, of course, and is a major problem in some areas of the world where industrial emissions from burning hydrocarbon fuels react with gases in the atmosphere to produce acidic compounds that fall as rain.

Woolbert U.S. Pat. No. 4,852,384 initiates a calibration sequence for a combined oxygen and combustibles analyzer, using an automatic periodic calibration system with a signal sensing and safety alarm system. Both oxygen and the fuel are analyzed and controlled. The system is designed to replace manual testing where an operator introduces a test gas into the system.

Dykema U.S. Patent No. U.S. Pat. No. 5,215,455 employs a plurality of combustion zones and stages while regulating temperatures of combustion. At least two stages are used in which the first combustion zone is fuel-rich to convert chemically bound nitrogen to molecular nitrogen. The second zone includes two combustion stages that are said to avoid production of $NO_x$ because of a cooling step substantially lowering the final combustion temperatures.

Koppang U.S. Pat. No. 5,759,022 uses a secondary burn zone downstream from the primary burn zone to reduce production of $NO_x$, also in a fuel-rich mixture. This patent relates to liquid and gas hydrocarbon fuels, and depends upon intermixing these fuels with oxygen during the process. Koppang is said to be an improvement on Quirk et al. U.S. Pat. No. 5,849,059, which patent reacts waste gasses in a glass furnace. This reference uses a secondary combustion by adding air to exhaust gases as they leave a regenerator to combust and remove combustible material in the waste gas before exiting to atmosphere.

Ashworth U.S. Pat. No. 6,085,674 discloses three stages of oxidation in which gas and preheated air are introduced in stages. $NO_x$ production is reduced by first partially combusting the fuel in the presence of heated combustion air, then removing molten slag in the second stage and causing further combustion. The flue gas then is combusted in a third stage to complete combustion of the fuel $NO_x$ is said to be reduced by controlling the stoichiometric rations at each stage of combustion.

Finally, Miyagaki U.S. Pat. No. 4,622,922 uses images from cameras and fiber optics to control combustion. The amount of $NO_x$ and unburned coal in the ash are measured and a trial and error process is used in trial operations to attempt to achieve stability of combustion and meet some standard of emission output.

None of the prior art is able to effectively control the production of $NO_x$ and optimize the efficiency of the combustion when optimization of combustion air is not constant but is uncertain. Variations in CO production during combustion have prevented full optimization of $NO_x$, production, and have not allowed comparison of efficiency and emission of undesirable components such as $NO_x$.

It would be of great advantage in the art if a method could be produced that would utilize information relating to combustion uncertainty and its relationship to formation of CO emissions in pulverized coal fired boilers.

It would be another great advance in the art if analysis of the emissions could be done in a region of the system where CO emissions occur with prescribed probability.

Other advantages will appear hereinafter.

SUMMARY OF THE INVENTION

It has now been discovered that the above and other objects of the present invention may be accomplished in the following manner. Specifically, the present invention provides method of controlling combustion of fuel in a boiler having an adjustable air-to-fuel ratio.

The CO production at any given time in a boiler will be very highly varied. There is no linear relationship to use to pick any given point for use in controlling the air to fuel ration because, of course, at any given time a median, since the distribution is not symmetrical will have 50% of the CO production above that point and 50% below that same point. For that reason, the present invention includes the measurement of CO production over time to provide a CO distribution range during that period of time for the combustion.

Similarly, the $NO_x$ production will give the same wide deviation from any average measurement. Accordingly, the measurement of $NO_x$, production is done over time to provide measuring the $NO_x$, production to provide a $NO_x$, distribution range during said period of time.

In both cases, it is necessary to estimate the distribution of CO and $NO_x$, emissions, then select a set point, such as 90% or 95% of the total distribution, by way of example, so that during operation, the emissions will remain below the maximum permitted level with the probability given by said set point. The operator is then able to adjust the air-to-fuel ratio to cause combustion of the fuel within the CO distribution range and the $NO_x$ distribution range to thereby cause the actual emission for said CO and $NO_x$ distributions to average less than the maximum permitted.

BRIEF DESCRIPTION OF THE DRAWINGS

For a more complete understanding of the invention, reference is hereby made to the drawings, in which:

The FIGURE is a schematic view of a plot of air to fuel ratio against gasses measured and/or estimated in flue gasses.

DETAILED DESCRIPTION OF THE PREFERRED EMBODIMENT

Figure 1:
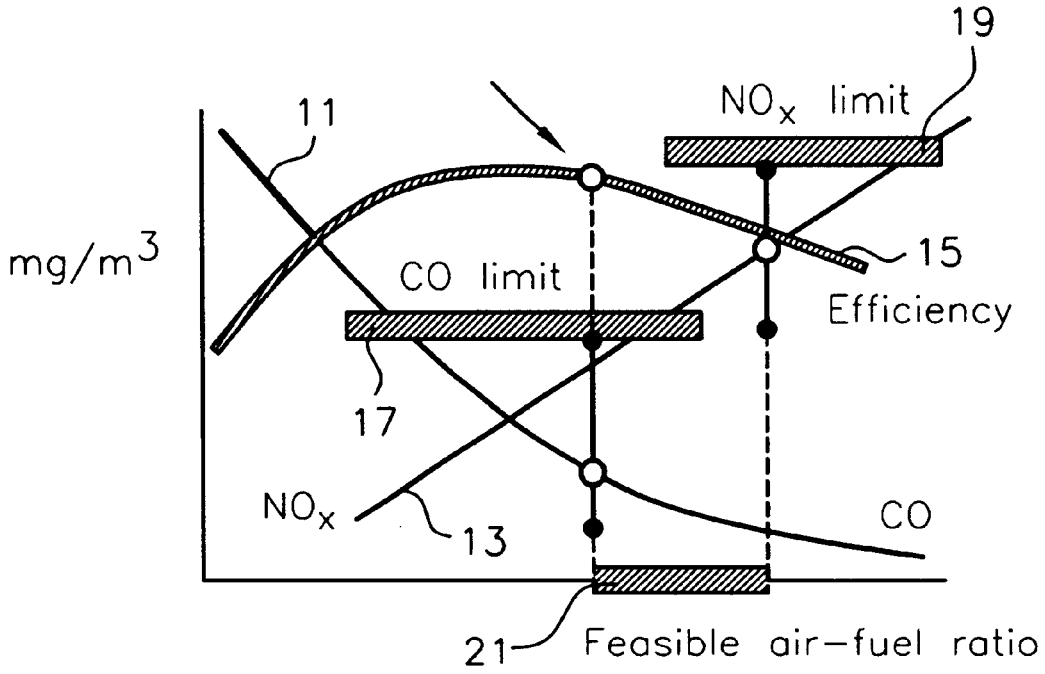

CO emission in boilers varies significantly and widely over varying air to fuel ratios. This is true particularly when pulverized coal is burned, but also occurs in any fuel that has variations in its combustible content. As an example, suppose the stoichiometric air-fuel ratio is 5 $m^3$ of air per 1 kg of fuel (pulverized coal). Then in a range of air-to-fuel ratios between 5.4 and 6.6 $m^3$ per kg, the specific CO production will range at any time from about 50 $mg/m^3$ CO to as much as 200 or 250 $mg/m^3$. Similarly, $NO_x$ production for that same air-to-fuel ratio might range from just over 100 mg/m$^3$ to as high as 350 to 400 mg/m$^3$ or more. A study of data from flue gas analyzers have shown that the variability of CO production rate as a function of air-to-fuel ratios increases greatly with a decrease in excess air. However, low excess air is desirable for both low $NO_x$, burning and high efficiency. The present invention takes into account not only the average CO and $NO_x$ production at a given power level but also the uncertainty or variability of the prediction.

Shown in the FIGURE are error bars that determine the feasible range of air-to-fuel ratios, over which the optimization is statistically guaranteed not to exceed the CO and $NO_x$ emission limits while maximizing the thermal efficiency of combustion. The x axis of the display shown in the FIGURE is the air-to-fuel ratio, while emissions are shown on the y axis (mg/m$^3$), so that curve 11 represent the exponential increase in CO production with decreased air in the air-to-fuel ratio. Curve 13 represents the decrease in $NO_x$ production with the same decreased air in air-to-fuel ratios. Curve 15 represents the efficiency of burning, as determined by the losses in unburned fuel and losses in the exhaust gases. The air-to-fuel ratio that is permitted by the system of this invention ranges from the limit defined by the range of CO production bar 17, and the limit defined by the range of $NO_x$ production bar 19. The permitted or feasible air-to-fuel range is shown by bar 21, between the two limits as defined herein.

While the use of estimated averages will not eliminate spikes in production of either byproduct it has been found that the calculation of estimated distributions will ensure that actual CO and $NO_x$ production do not exceed the maximum permitted at the power station. With the use of the intervals of occurrence as defined herein, 90% of the production of CO and $NO_x$, will actually be below the maximum to compensate for the 10% (or other selected value) that exceeds the allowable amount. Where there is steady state combustion, very few peaks exceed the required limits and the average never does. The set point is determined by the operator and is selected to insure full compliance with requirements. As a result, a stable operation of the boiler, using a relatively unchanged air to fuel ratio, provides much higher efficiency of operation, saving money and complying with regulations for CO and $NO_x$ production.

The typical time period used for evaluation of average emission production by environment monitoring authorities is between 15 and 30 minutes, although any time is suitable as long as the sensors provide adequate data to make actual distribution ranges for both the CO distribution range and the $NO_x$ distribution range.

The air-to-fuel ratio is preferably adjusted to cause combustion of said fuel within said CO distribution range and said $NO_x$, distribution range to thereby cause the actual emission for said CO and $NO_x$ distributions to produce actual emissions with 90% of values under the maximus. As can be readily appreciated, the combustion process operates at admirable efficiency and control allows the operator to maximize energy produced while keeping the emissions under control.

While particular embodiments of the present invention have been illustrated and described, it is not intended to limit the invention, except as defined by the following claims.

What is claimed is:

1. A method of controlling combustion of fuel in a boiler having adjustable air-to-fuel ratios, comprising the steps of:

measuring the CO emission production to provide a CO emission distribution range during a period of time for said combustion;

measuring the $NO_x$ emission production to provide a $NO_x$ emission distribution range during said period of time for said combustion; and adjusting the air-to-fuel ratio to cause combustion of said fuel within said CO emission distribution range and said $NO_x$ emission distribution range to thereby cause the actual emission for said CO and $NO_x$ emission distributions to average less than the maximum permitted at the power station.

2. The method of claim 1, wherein said period of time ranges from 15 to 30 minutes.

3. The method of claim 1, wherein said air-to-fuel ratio is selected to produce actual emissions averaging 95% of said maximum.

4. The method of claim 1, wherein said air-to-fuel ratio is selected to produce actual emissions averaging 90% of said maximum.

5. A system of controlling combustion of fuel in a boiler having an adjustable air-to-fuel ratio, comprising:

a first sensor for measuring the CO emission production to provide a CO emission distribution range during a period of time for said combustion;

a second sensor for measuring the $NO_x$ emission production to provide a $NO_x$ emission distribution range during said period of time for said combustion; and a controller for adjusting the air-to-fuel ratio to cause combustion of said fuel within said CO emission distribution range and said $NO_x$ emission distribution range to thereby cause the actual emission for said CO and $NO_x$ emission distributions to average less than the maximum permitted at the power station.

6. The system of claim 5, wherein said period of time ranges from 15 to 30 minutes.

7. The system of claim 5, wherein said air-to-fuel ratio is selected to produce actual emissions averaging 95% of said maximum.

8. The system of claim 5, wherein said air-to-fuel ratio is selected to produce actual emissions averaging 90% of said maximum.

9. A system of controlling combustion of fuel in a boiler having an adjustable air-to-fuel ratio, comprising:

first sensor means for measuring the CO emission production to provide a CO emission distribution range during a period of time for said combustion;

second sensor means for measuring the $NO_x$ emission production to provide a $NO_x$ emission distribution range during said period of time for said combustion; and controller means for adjusting the air-to-fuel ratio to cause combustion of said fuel within said CO emission distribution range and said $NO_x$ emission distribution range to thereby cause the actual emission for said CO and $NO_x$ emission distributions to average less than the maximum permitted at the power station.

10. The system of claim 9, wherein said period of time ranges from 15 to 30 minutes.

11. The system of claim 9, wherein said air-to-fuel ratio is selected to produce actual emissions averaging 95% of said maximum.

12. The system of claim 9, wherein said air-to-fuel ratio is selected to produce actual emissions averaging 90% of said maximum.

* * * * *